United States Patent [19]

Haussmann

[11] Patent Number: 4,923,002

[45] Date of Patent: May 8, 1990

[54] HEAT EXCHANGER RIB

[75] Inventor: Roland Haussmann, Leimen, Fed. Rep. of Germany

[73] Assignee: Thermal-Werke, Warme-Kälte-Klimatechnik GmbH, Hockenheim, Fed. Rep. of Germany

[21] Appl. No.: 111,481

[22] Filed: Oct. 22, 1987

[51] Int. Cl.[5] ..... F28D 1/04

[52] U.S. Cl. ..... 165/151; 165/182

[58] Field of Search ..... 165/151, 182

[56] References Cited

U.S. PATENT DOCUMENTS

| | | | |
|---|---|---|---|
| 1,416,570 | 5/1922 | Modine | 165/151 |
| 1,557,467 | 10/1925 | Modine | 165/151 |
| 1,575,864 | 3/1926 | Owston . | |
| 2,046,791 | 7/1936 | Przyborowski | 165/182 X |
| 3,645,330 | 2/1972 | Albright et al. | 165/151 |
| 4,691,768 | 9/1987 | Obosu | 165/151 |
| 4,705,105 | 11/1987 | Cur | 165/151 |

FOREIGN PATENT DOCUMENTS

| | | | |
|---|---|---|---|
| 496733 | 4/1930 | Fed. Rep. of Germany . | |
| 1501550 | 12/1965 | Fed. Rep. of Germany . | |
| 2518226 | 11/1975 | Fed. Rep. of Germany . | |
| 2530064 | 1/1977 | Fed. Rep. of Germany . | |
| 7806410 | 2/1979 | Fed. Rep. of Germany . | |
| 2756941 | 6/1979 | Fed. Rep. of Germany . | |
| 3131737 | 4/1982 | Fed. Rep. of Germany . | |
| 3336985 | 3/1985 | Fed. Rep. of Germany . | |
| 2494421 | 5/1982 | France | 165/151 |
| 0053698 | 4/1980 | Japan | 165/151 |
| 0165594 | 7/1986 | Japan | 165/151 |
| 332455 | 7/1930 | United Kingdom | 165/151 |
| 2088544 | 6/1982 | United Kingdom | 165/151 |

*Primary Examiner*—Carl D. Price
*Attorney, Agent, or Firm*—Spencer & Frank

[57] ABSTRACT

A rib or fin for the joint ribbing of a plurality of heat exchanger tubes in a ribbed-tube heat exchanger for motor vehicles in which the ambient air flows as a first heat exchange fluid along the surface of the rib or fin and a second heat exchange fluid is conducted in the heat exchanger tubes. The rib is corrugated in the direction of flow of the first fluid. The rib is provided with shaped-on connecting sleeves which serve as a connection to the heat exchanger tubes. At least one wave crest of the corrugation extends between two connecting sleeves that are adjacent one another transversely to the flow direction of the first fluid, and local air guidance profiles are shaped in the corrugated surface of the rib in the spaces between the connecting sleeves. The air guidance profiles are constituted by at least predominantly closed bulges which have a lower height than the distance between the ribs when assembled in the heat exchanger and the bulges are each disposed on a slope of the corrugation.

19 Claims, 5 Drawing Sheets

HEAT EXCHANGER RIB

BACKGROUND OF THE INVENTION

Field of the Invention

The present invention relates to a rib or fin made of aluminum or an aluminum alloy for the joint ribbing of a plurality of heat exchanger tubes in a ribbed-(or finned) tube heat exchanger for motor vehicles. More particularly, the present invention relates to a rib or fin made of aluminum or an aluminum alloy for the joint ribbing or finning of a plurality of heat exchanger tubes in a ribbed or finned tube heat exchanger for motor vehicles, wherein: the ambient air flows, as a first heat exchange fluid, along the surface of the rib and a second heat exchange fluid is conducted in the heat exchanger tubes; the rib is corrugated in the direction of flow of the first fluid; connecting sleeves for connection to the heat exchanger tubes are shaped to the rib, with at least one corrugation wave crest extending between two connecting sleeves disposed adjacent one another transversely to the flow direction of the first fluid; and local air guidance profiles shaped in the corrugated surface of the rib are provided in the spaces between connecting sleeves.

Heat exchanger ribs of the above type are disclosed in DE-OS No. 2,530,064. They are charged from the exterior by the ambient air as the first heat exchange fluid while a second heat exchange fluid is conducted within the heat exchanger tubes which are ribbed or finned by the addition of ribs or fins.

At present, ribs or fins for ribbed tube heat exchangers in motor vehicles are generally manufactured of aluminum or aluminum alloys with very thin wall thicknesses between typically 0.08 and 0.15 mm. The manufacture of such ribs of sheet iron is practically out of the question because their thermal conductivity is four times worse than that of aluminum ribs, and for reasons of corrosion and weight. High-grade steel sheet would be resistant to corrosion but has only about 10% of the thermal conductivity of an aluminum rib or fin. The manufacture of such ribs of copper would meet the requirements with respect to corrosion resistance or thermal conductivity, which is even better, but, except for some special cases, e.g. in some engine radiators or solderable heating system heat exchangers, cannot be used for reason of their weight and because of the price of copper compared to the price of aluminum.

In this sense, the development of heat exchangers for motor vehicles as mass produced articles has been geared toward optimizing not only the performance data, but also their weight, structural volume, the use of material and the like, so as no longer to permit a simple comparison with heat exchangers for other applications which are produced in small numbers down to production in individual units.

For such ribs or fins it is desired to produce, with easily manufactured, durable means, the highest possible heat transfer coefficient between the rib or fin, on the one hand, and the gaseous first fluid charging the rib, on the other hand. This increase in the heat transfer value brings about savings in investment costs and during operation since, with the same quantity of heat to be transferred and at the same operating temperatures, the frontal surface of the heat exchanger (the upstream surface) and the structural depth can be reduced or the spacing of the heat exchanger ribs can be enlarged. Since the heat exchanger rib or fin is used in ribbed-tube heat exchangers in motor vehicles, the reduction of structural volume and the concomitant reduction in the weight of the heat exchanger are of decisive significance. This applies to their possible use in motor vehicle radiators or as heating system heat exchangers, as well as to their preferred use in liquefiers or evaporators in motor vehicle air-conditioning systems.

The exchange of heat between the two fluids is effected by means of heat radiation, heat conduction and convection, particularly, however, by way of convection in which the heat is transferred by moving particles of a substance. The exchange of heat by convection is decisively dependent on the type of flow of the first gaseous fluid around the tubes and the heat exchanger rib or fin.

It is known that with a flow parallel to a plate, a laminar boundary layer forms at the surface and becomes thicker with increasing length of the flow path L to thus impair the exchange of heat by convection since this laminar boundary layer is able to transfer the heat only by way of molecular conduction processes. Qualitatively, the external heat transfer coefficient is described by the following formula:

$$\alpha_a = c \cdot \sqrt{\frac{w}{L}}$$

where $\alpha_a$ is the heat transfer coefficient averaged over the length L of the plate for heat transfer from the gaseous fluid to the surface of the rib, fin or plate;

w is the flow velocity of the gaseous medium charging the ribs;

c is a constant resulting from the physical characteristics of the flowing medium.

The equation indicates that the heat transfer coefficient of plates can be improved by either increasing the flow velocity or decreasing the length of plate L over which the fluid flows.

A further reduction in the exchange of heat is the result of dead flow spaces which build up downstream of the tube regions when seen in the direction of flow of the first fluid, i.e. in their areas shaded from the flow. Due to a low intensity stationary turbulence created by the flow downstream of the heat exchanger tubes, the local heat transfer coefficients at such regions become considerably smaller than in the regions in the path of the main stream. With continued reduction of the rib, fin, or plate thickness, the heat conduction resistance in the rib must be given increasing consideration, and this results in the requirement for the most uniform heat current density throughout the rib with constant tube spacing. This, in turn, is realized by adapting the local heat transfer coefficients. To meet this requirement, it is known to give the ribs various profiles. One of the simplest known profiles resides in a corrugated configuration of the rib in the direction of flow of the first fluid so that the wave crests and troughs extend transversely to this direction of flow (see, for example, DE-OS No. 2,530,064 which belongs to the same species, as well as for example DE-OS No. 2,756,941). This corrugation, on the one hand, slightly lengthens the flow path and thus the flow velocity between the ribs or fins and, on the other hand, the required deflection of the air in the corrugated rib causes the laminar boundary layer to be at least partially reconstructed after each wave crest, thus avoiding, at least somewhat, an enlargement of the boundary layer and a reduction of the external heat transfer coefficient corresponding to the above equation. This is particularly applicable if the wave crests are relatively sharp, particularly if they have the shape of edges of a linear zigzag corrugation. However, rounded wave crests are also included in the scope of the present invention.

Yet, there are limits for the external heat transfer coefficient with respect to a smooth plate since, beginning with a corrugation angle $\theta$ of 15° to 20°,the heat transfer coefficient increases only slightly while the pressure loss on the air side increases more and more. The increase in the external heat transfer coefficient realized exclusively by corrugation is insufficient in the range of an industrially worthwhile ratio of power increase to increased pressure losses, i.e. corrugation angles up to a maximum of 20°, since the reduction of the laminar boundary layer by the corrugation is insufficient and, moreover, the increase in surface area as well as the increase in flow velocity are still relatively small (6%) for a corrugation angle of at most 20°. Additionally, corrugated rib surfaces do not result in a significant reduction of the dead flow spaces downstream of the tubes and in an optimum distribution of the local heat transfer coefficients with respect to uniform radial heat current density. Corrugation angles of about 45°, as they are shown in the drawings of DE-OS No. 2,530,064, lead to a larger boundary layer through which the heat must be transported as a result of molecular conduction of the air since the air flows only to a small extent parallel to the corrugation and a low intensity stationary turbulence develops in each wave trough. The great increase in surface area of 30% to 40% depending on the surface area percentage of the sleeve-shaped tube connection areas is compensated for the most part by the above-described increase in the thickness of the boundary layer so that the increase in the external heat transfer coefficient, as experience has shown, is only insignificantly larger than for a corrugation angle of 20° (FIG. 7).

For uncorrugated ribs or fins, new profile shapes have been developed which are pressed out of the rib itself, thus producing perforations in the rib material. All these profiles have in common that the shaping of the rib is to prevent, as much as possible, the development of a laminar boundary layer of greater thickness. A prior art profile of this type (DE-GM No. 78 06 410) attempts to conduct the gaseous fluid in a pressed-out guide channel which has a semicircular cross section into the flow shade area behind the tube connection locations. The cutting edges created at the beginning and end of each guide channel require a new development of the thermal and hydraulic flow profile. Aside from the fact that it is doubtful that the guide channels interfere with the formation of performance reducing turbulence regions, the cutting edges are limited to only a small percentage of the surface area of the rib, while a large portion of the surface area of the rib or fin is configured as a smooth rib or fin without boundary layer reducing profiles.

A more uniform distribution of rib perforations and guide webs is disclosed in the prior art arrangement (DE-OS No. 2,5128,226) of a heat exchanger rib or fin for the chemical industry, particularly the petroleum industry, in which a plurality of narrow guide webs, with which the laminar boundary layer is to be forced to constantly reconstruct itself, are provided between two tube connections in the rib. However, in fact, this measure appears to be a drawback since the slits in the heat exchanger rib or fin associated with the outer guide webs would then make the flow of heat from the tubes, to be attached at the tube connections, to the outer guide webs more difficult because of a partially considerably longer flow path, so that a greater temperature difference would be required for the heat transport and thus the efficiency of the fins would be reduced. Since the outer guide webs are disposed closely on top of one another in the same plane, the boundary layer formed in the preceding slit is also not reduced completely. Moreover, the automotive engineer of average skill in the art, even if he is occupied with the construction of heat exchangers for motor vehicles and particularly their air-conditioning systems, will not look around among heat exchanger structures for the chemical industry.

The last mentioned technical drawback is overcome in DE-OS No. 3,131,737 which relates to room heating and cooling systems in that the ribs or fins of the ribbed tube heat exchangers disclosed there have guide webs in the form of embossed roof-shaped strips which are arranged to form bridges with respect to one another. Although this configuration of the guide webs is better with respect to boundary layer reduction and rib stability, it again has the drawback that it is impossible to develop a radial heat flow with an at least approximately invariable angle around the heat exchanger tubes.

Moreover, the manufacturing tools for this rib or fin are particularly complicated and, for a given performance, high pressure losses result, particularly in the case of additional condensation of steam due to the rib temperature dropping below the dew point. In the latter case, condensation water will be retained between the many guide webs by adhesion as in a sponge, so that the rib or fin surface is blocked with condensation water and the heat transfer becomes even worse than with a smooth fin.

According to an improvement (German Patent No. 3,336,985) of this basic type of construction, air-side pressure losses are reduced with the heat transfer coefficient remaining the same and the required manufacturing tools are simplified in that at least one perforation is provided between adjacent tube connections in the same row and at least one guide web is provided for the gaseous fluid, with this guide web being placed out of the plane of the rib or fin at an edge of the perforation which extends transversely to the row and adjacent a tube connection location. The guide web, on the one hand, reduces the laminar boundary layer and, on the other hand, conducts the air in such a manner that the formation of a turbulence region downstream of the tubes is avoided. However, the required width of the guide webs, measured in the direction of flow of the gaseous fluid, of at least three-quarters of the outer diameter of the tube connection, reduces the stability of the ribs or fins to such an extent that, with a given rib (fin) stability, the thickness of the material must be increased, as the use of harder rib material is made impossible due to the maximum attainable height of up to 2.4 mm for the sleeve-type tube connections. Even if the thickness of the material were increased from 0.12 mm to 0.15 mm, certain stability problems would result in handling during the manufacturing process in a packet of ribs in which the tubes are not yet introduced into the sleeve-shaped tube connections so that relatively high production times must be accepted. Moreover, the problems of soiling and the entrapment of water if the rib temperature drops below the dew point are not completely solved, analogously to the heat exchanger rib or fin according to DE-OS No. 3,131,737.

In the same type of rib or fin disclosed in DE-OS No. 2,530 064 intended for use in motor vehicle radiators, attempts have already been made to further improve the heat transfer coefficient of a corrugated fin in that flaps projecting from the fin and formed of punched-out tear holes serve to form spacers between successive individual ribs in the rib packet of the ribbed tube heat exchanger and are set at an angle to the flow of the first fluid to serve as local air guide profiles. By a grid-like arrangement of these sloped air guide sheets in the gaps between mutually offset heat exchanger tubes or between the connecting sleeves of the rib accommodating the heat exchanger pipes, the charging of the rib or fin with the first fluid in the regions shaded from the air by the heat exchanger tubes is to be improved. The corrugation of the rib or fin is here so short-waved that each tear hole together with two mutually parallel flaps occupies two slopes of the corrugation while bridging a wave crest in each case. In the region of the tear hole, the corrugation and its desirable effect are then eliminated. However, this configuration including the tear holes and the sharply bent flaps which take up the entire space between adjacent ribs is predestined to collect condensation water generated when the rib temperature drops below the dew point as well as dirt. Moreover, the flaps which take up the entire space between ribs are relatively large-area turbulence generators with their own air shaded region effect for the gaseous first fluid and, connected with this, even cause a reduction of the heat transfer between the ribs and the gaseous first fluid. The oblique position of the flaps in only one possible sloping direction appears to be unmotivated since the first fluid does not know a preferred lateral direction of flow. Multiplying the flaps serving as spacers would increasingly block the flow cross section of the rib or fin packet for the first fluid and would thus likewise counteract the desired increase in efficiency. The resulting improvement of the prior art measure with respect to the heat transfer coefficient should therefore at most be slight and would become significant only if spacers for the ribs or fins in the rib or fin packet were separated from the holding sleeves for the ribs or fins. Instead, within the scope of the present invention, such separate spacers are preferably avoided entirely since applicant's earlier rib or fin structures (see German Patent No. 3,336,985) already provide the connecting sleeves of the ribs, where they are attached to the heat exchanger tubes, with collars which engage in corresponding grooves on the rear of the next fin and thus permit use of the connecting sleeves simultaneously as spacers for the fin packet. However, the present invention is not limited to this case but also leaves open the use of separate spacers, although this is not a preferred possibility.

Essentially closed bulges made in planar ribs or fins are known for ribbed-tube heat exchangers which are disclosed for other materials than for aluminum or aluminum alloys. For example, this is disclosed in German Patent No. 496,733 which dates from 1930 and in which the ribs or fins are made of sheet metal and are soldered to the tubes. Obviously, sheet iron or stainless steel (high-grade steel) sheet material is contemplated since the configuration of sheets with choke locations disposed between the tubes and air guide means for guiding the air flowing through the fin packet into the shaded air flow regions behind the tubes is directed to a material in which otherwise the lack of thermal conductivity in the above-mentioned shaded air flow regions would result in excess temperature drops and thus in a reduction of efficiency. This would not be the case with ribs or fins made of copper. Thin ribs or fins made of aluminum in which air flow shaded region problems also result did not exist at that time. Moreover, the expressly desired throttling between the tubes leads to high pressure losses. For all of these reasons, this prior art heat exchanger is not suitable for use in motor vehicle construction.

Particularly for motor vehicle radiators, solderable ribs or fins, primarily made of copper, are already disclosed in U.S. Pat. No. 1,575,864 of 1926 in which pointed, particularly conical, bulges which are closed in the plane of the rib (fin) project on one or both sides from a planar rib. Such bulging in planar fins have been considered again and again since the thirties, even by applicant, in various modifications, but has just as often been rejected because the realizable increase in surface area and the initiation of turbulence is not sufficient for the required performance density compared to other disclosed configurations of that time and of the type discussed above. Moreover, this prior publication does not provide an example for possibly arranging such bulges in such a manner that the flow is conducted into air shaded regions downstream of the tubes. Because of the use of copper as the rib material, this is also not necessary in the prior art heat exchanger.

Ever since the early thirties, development of rib or fin constructions for ribbed- (finned-) tube heat exchangers for motor vehicles has gone different ways, without it being considered to combine corrugated ribs or fins and essentially or completely closed bulges on ribs in some way. To the contrary, in the above-mentioned German Patent No. 496,733, the throttling structure selected there is expressly mentioned as an alternative for a certain type of known corrugation, namely a corrugation concentrically around the tubes, without considering at all a combination of corrugation and bulges.

SUMMARY OF THE INVENTION

It is an object of the present invention to provide a rib or fin for the joint ribbing or finning of a plurality of heat exchanger tubes in a ribbed tube heat exchanger for motor vehicles in which excellent heat transfer conditions with good discharge of condensation water if the temperature drops below the dew point are combined with good rib stability and for which, if possible, only simple manufacturing tools and low maintenance expenditures are required.

The above object is generally achieved according to the present invention in that in a rib for the joint ribbing of a plurality of heat exchanger tubes in a ribbed-tube heat exchanger for motor vehicles of the type wherein the ambient air flows, as a first heat exchange fluid, along the surface of the rib and a second heat exchange fluid is conducted in the heat exchanger tubes, and with the rib being made of aluminum or an aluminum alloy, being corrugated in the direction of flow of the first fluid, having connecting sleeves, for connection of the rib to the heat exchanger tubes, shaped to the rib and disposed such that at least one wave crest of the corrugations extends between each two of the connecting sleeves disposed adjacent one another transversely to the flow direction of the first fluid, and having local air guidance profiles shaped in the corrugated surface of the rib in the spaces between the connecting sleeves; the air guidance profiles are constituted of at least predominantly closed bulges of a height less than the distance between adjacent ribs in the heat exchanger, and each bulge is disposed on a slope of the corrugation.

The outstanding feature of the rib or fin according to the invention is that a further local profile impressed into the slopes of the basic corrugation of the fin in the form of completely or almost completely closed bulges of a smaller height than the rib or fin spacing results in a noticeable increase in the external heat transfer coefficient $\alpha_a$ so that even heat transfer coefficients previously realized only with slit ribs or with perforated ribs (German Patent No. 3,336,985), which in the past have been considered the optimum, can be clearly exceeded, for example by about 8% to 20%, and this with only a slight increase in pressure losses on the air side (first fluid).

Only with corrugated ribs—even with the optimum linear zigzag—can increases in performance be realized at all up to a corrugation angle $\theta$ of 15° to 20°. However, the heat transfer coefficient realized then lies considerably below the heat transfer coefficients possible with slit ribs or fins (German Patent No. 3,336,985).

With a larger angle $\theta$, only a slight increase in performance can be expected but a large increase in pressure losses on the air side (FIG. 7) must be expected since the boundary layer through which the heat must be transported by means of molecular conduction processes, becomes larger due to low intensity stationary turbulences which form in each wave trough. With the rib according to the present invention it is sufficient to select the corrugation angle $\theta$ only up to its thermodynamically appropriate maximum value of 15° to 20° and to realize further controlled turbulence initiation and surface enlargement by means of the indentations behind which no dead flow spaces are able to form. Thus, the turbulence initiating and boundary layer reducing effect of the raised portions (bulges) inures to the full benefit of the downstream rib surface without being cancelled out by local increases in the boundary layer. The increase in surface area obtained by the raised portions also has a performance increasing effect. The bulges can here be configured and distributed in such a manner that the current density of the heat stream is practically always identical on concentric circles around the connecting sleeves, i.e. the heat stream is in a distribution with respect to the connecting sleeves which does not vary with its direction. In this connection it must be emphasized, in particular, that the flow of the first fluid is split into stream lines and these lines are conducted also into the regions of previous dead flow spaces.

The resulting advantages of the above-mentioned specific combination of a corrugation of the ribs (fins) and essentially or completely closed bulges is the more surprising since this also creates a new way for producing ribs that are highly efficient even when compared with other types of configurations, and whose creation in the past, when they were configured to have only corrugations or only bulges, was always doomed to failure. Compared to applicant's most effective rib produced in the past, which had a completely different configuration, i.e. as disclosed in German Patent No. 3,336,985, the external heat transfer coefficient can be increased between about 8% and 20% and thus, under the same operating conditions, with the same material and the same dimensions, i.e. under completely identical conditions except for the different type of rib configuration, the transferred thermal energy can be increased by about 5% to 10%.

The configuration of the heat exchanger rib according to the invention is recommended primarily for use in motor vehicles as an evaporator or air cooler in which, when the temperature drops below the dew point, condensation water develops on the rib. By the practical elimination of all projections, slits or perforations in the rib, the condensation water can flow off with less interference so that the water retention capability is always less. Due to the smaller quantity of condensation water retained by adhesion between the heat exchanger ribs in the heat exchanger rib according to the present invention, the external heat transfer coefficient is further improved, on the one hand, since the thermal resistance by condensation water is reduced, and, on the other hand, the rib surface dries faster, thus reducing the activity of odor forming bacteria.

Another advantage of the low water retention capability of the heat exchanger rib according to the invention is its better suitability for reheating (in motor vehicle air-conditioning systems) since the subsequently evaporated quantity of water is less and thus there is less fogging of the windshield once the compressor is shut off.

Due to the great deformation of the rib practically without perforations, its stability is increased considerably, particularly when compared to slit ribs, so that for the same strength the thickness of the rib can be reduced considerably.

In conjunction with the above-mentioned increase in performance of the heat exchanger rib according to the invention when compared to other high performance ribs (e.g. German Patent No. 3,336,985), the thickness of the rib can be reduced considerably without producing reductions in performance compared to the mentioned high performance fins according to German Patent No. 3,336,985. Since heat exchanger ribs are manufactured for the automobile industry in inestimably large numbers, reduction of material costs and weight and the resulting improvement in driving and reduction in gas consumption is of decisive advantage. A further advantage in the mass production of heat exchanger ribs is the elimination of the cutting dies required to produce the perforations in the rib according to German Patent No. 3,336,985 which involve high maintenance costs, while the tool bits for the production of the profile in the rib according to the invention are almost maintenance free.

It is understood that the person of average skill in the art will properly select the size, shape, number and distribution of the bulges for the intended purpose. That is, such a person will not select too small a number of large bulges, but also not too many small bulges, since otherwise the air of the first fluid will be unable to follow the rib. Too large bulges, however, would already harbor the danger of creating their own dead flow spaces. Moreover, they are less suitable for the optimum distribution into stream lines. The length of each corrugation also has a relationship to the size of the bulges, since each bulge is associated with only one slope of a corrugation and is thus set back in its respective base region with respect to the next wave crest. Preferably, the bulges or raised portions, are spaced from both ends of the slope of the corrugation and/or have a maximum cross-sectional dimension, i.e., maximum diameter in the case of a conical bulge, of between 50% and 80% of the slope length, so that the bulges according to the invention extend over only part of the slope length of the corrugation, and the corrugation in turn is optimally selected so that it has a periodic linear zigzag course whose pitch angle ($\theta$) is in the range of 10°–30°, and so that there are two or three slopes for each corrugation of a rib between two adjacent connection sleeves of a row of the heat exchanger.

The arrangement of the knob-like bulges is also of significance, in dependence on the tube distribution, for the increase in the heat transfer coefficient. For example, if two connecting sleeves are spaced close together transversely to the direction of the air, two bulges arranged flush or aligned with one another in the direction of the air flow (see for example FIG. 1) may suffice to obtain a given heat transfer coefficient with low pressure losses, while for higher performance requirements, the arrangement of the bulges could be offset with respect to the direction of the air flow (see for example FIG. 2).

A further increase in the heat transfer coefficient is realized in the two above mentioned cases by the arrangement of more than two bulges on a corrugation slope between two adjacent connecting sleeves of a row, in which case the spacing between the centers of the bulges should be reduced as a function of the rib spacing b between two ribs in a rib packet so that the boundary layer does just not become thicker. Preferably each slope of the corrugation is provided with at least one bulge.

As indicated above, the optimum geometry of the zigzag corrugation is a linear zigzag corrugation with a pitch angle in the range of 10°–30°. In this case, it is advisable to have a small number of wave crests between two adjacent tube connections in a row of tubes, preferably only one wave crest, if the spaces between ribs are large, while in the region of a desired small rib spacing, 1.5 or 2 wave crests should preferably be selected, i.e., the number of corrugation slopes between adjacent connecting sleeves of a row is at least three. With a given geometry of the tube connections and a maximum corrugation angle $\theta$ of 15° to 20°, the number of wave crests results in the effective height of the corrugation, measured at a right angle to the base surface or major plane of the rib. The height of the bulges is measured as a projection perpendicular to the flank or edge of the rib and, is at least 15% and at most 80%, but preferably 30% to 50%, of the spacing between ribs in a ribbed-tube heat exchanger.

According to a feature of the invention, the free ends of the connecting sleeves are provided with collars, the rib or fin is provided on its surface facing away from the connecting sleeves, and in particular the collars, with a complementary annular receiving trough for a collar of an adjacent rib of a rib packet, and the width of the trough is less than one-half the slope length. Moreover, the rise from the receiving trough to the wave crest preferably is not more than 20° steeper than the pitch angle ($\theta$) of the corrugation. These features thus relate to the already mentioned spacing of ribs by means of the connecting sleeves and emphasize the necessity of having the most uniform profile possible over the entire rib or fin surface in order to obtain a maximum heat transfer coefficient with relatively low pressure losses on the air side. According to the above mentioned latter feature, surfaces having angles that are too large with respect to the base surface of the rib or fin should be avoided since at these locations in the rib or fin packet of a ribbed-(finned-)tube heat exchanger, the rib or fin spacing is reduced by a factor of cos $\theta$ and thus the water retention capability increases with decreasing spacing between ribs.

Preferred configurations for the bulges are conical shapes, roof shapes, (inverted V-shaped), pyramid shapes, prism shapes or cylindrical shapes. Although at present conical shapes are considered to be particularly suitable, for the purpose of initiating turbulence and increasing surface area, other shapes as mentioned above are also permissible if they can be stamped without tearing the rib or fin. Axially symmetrical bulges are preferred; but elongate bulges, for example those having an oval cross section, can also be considered.

According to a further feature of the invention a special arrangement of the bulges is provided in order to obtain a constant heat current density in the rib or fin. According to this feature, the bulges are arranged in such a manner that more bulges are provided between two adjacent connecting sleeves of a row in the region of low flow velocities, i.e. where the spacing between tubes is large, and fewer or, in the borderline case, no raised portions or bulges are provided between two adjacent connecting sleeves in the region of high flow velocities, i.e. where the spacing between tubes is small.

The effect produced by such measures, that an approximately constant heat current density exists in the rib or fin on concentric circles around the connecting sleeves, likewise permits, in conjunction with the greater stability of the rib, a reduction in the rib thickness without reducing the efficiency of the rib, since the entire rib cross section available for heat conduction experiences a uniform "heat flow" on each concentric circle around the tube connecting sleeve and thus the conductivity of the entire rib is utilized uniformly. This is the great advantage of the heat exchanger rib or fin according to the invention compared to slit ribs or ribs provided with projections, perforations and guide webs which in the past have been used exclusively for high performance ribs; namely that no regions with extremely high heat transfer coefficients are created, rather the heat current density increases uniformly if the distance from the tube is decreased.

Preferably, in order to facilitate the manufacture of the rib or fin, all bulges and all tube connections project from the same side or surface of the rib or fin.

In contrast thereto, in the bridge-shaped strips formed by cutting into and raising the material as defined in DE-OS No. 3,131,737, the roof shape of the strips, on the one hand, and the necessary reconstruction of the laminar boundary layer, on the other hand, produce a locally extremely high heat transfer coefficient. However, the resulting extremely high heat current density when the heat current lines enter into the strips placed out of the rib plane requires a locally considerably higher temperature gradient since, for manufacturing specific reasons, the rib or fin material cannot be varied locally to correspond to the heat current density. The rising temperature gradient in the direction of the heat current lines from the tube connection to the middle of the bridge-like strip then results in a reduced temperature difference between the bridge-like strip and the gaseous first fluid flowing along the exterior of the heat exchanger rib or fin, thus reducing the quantity of heat transferred and preventing the locally very high heat transfer coefficients from being converted to transferred thermal energy.

The invention will be described in greater detail below with reference to schematic illustrations of embodiments thereof.

DETAILED DESCRIPTION OF THE PREFERRED EMBODIMENTS

FIGS. 1 to 4 show various embodiments of ribs or fins 1 of a ribbed-tube heat exchanger in which the surface profile described below was produced by deformation by way of punching, drawing or embossing rib sheet metal made of aluminum or an aluminum alloy and having a preferred thickness of 0.07 to 0.5 mm, preferably 0.07 to 0.15 mm.

Figure 8:
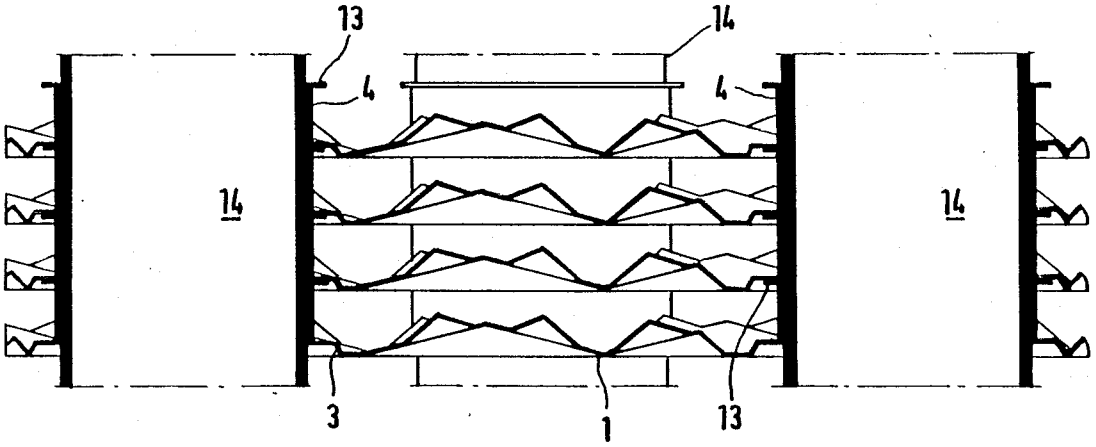
FIG. 8 is a schematic sectional view of a rib or fin packet according to the invention seen through the two respective axes of two adjacent heat exchanger tubes of a ribbed-tube heat exchanger.

A plurality of rows of connecting sleeves 4 extend in each heat exchanger rib 1 to accommodate heat exchanger tubes 14 (see FIGS. 8 and 9). In order to accommodate a heat exchange tube 14 carrying the second fluid, e.g., water, each connecting sleeve 4 is configured as a cylindrical, elliptical or otherwise configured sleeve in such a manner that a defined external diameter is produced, except for slight deviations, in the direction of the first gaseous fluid, e.g., air, which charges the heat exchanger rib 1 itself. The outer free edges of connecting sleeves 4 are here bent outwardly in the manner of an outer annual flange to form a collar 13 (See FIG. 5), thus fixing the mutual spacing of the ribs or fins 1 in the rib packet (core) of a ribbed-tube heat exchanger 22 (see FIGS. 5, 8 and 9). Connecting sleeves 4 themselves project from an annular receiving trough 3 which is formed in rib 1 on the surface side facing away from the respective connecting sleeve, and into which the corresponding collar 13 of the connecting sleeve 4 of an adjacent rib 1 engages when a plurality of ribs 1 are assembled in a heat exchanger to set the spacing b (FIG. 5) between adjacent ribs. When used in motor vehicle heat exchangers, ribs 1 are charged with ambient air as the gaseous first fluid which enters into heat exchange by way of rib 1 in the ribbed-tube heat exchanger 22 with the second fluid conducted in the heat exchanger tubes 14. Generally, the first fluid has a flow direction 2 which is transverse to the flow direction of the second fluid which follows the axial direction of heat exchanger tubes 14 and of connecting sleeves 4, respectively. In the illustrated top view of heat exchanger rib 1, flow direction 2 of the first fluid is identified by directional arrows.

Connecting sleeves 4 are disposed in rows transversely to flow direction 2 of the first fluid. Embodiments in which successive rows of connecting sleeves 4 are offset to the gaps of the preceding row, as shown in FIGS. 1 to 4, as well as those in which adjacent connecting sleeves 4 of successive rows are flush with one another in flow direction 2 (not shown in the drawing) can be used for this purpose. Both of these arrangements of the rib 1 are possible within the context of the present invention. Connecting sleeves 4 preferably have the identical configuration. In each row, adjacent connecting sleeves 4 are equidistant at a spacing i. The distances are generally also the same in different rows. Also, the distance c between successive rows seen in flow direction 2 are also identical. In the embodiment according to FIG. 1, two conical bulges or projections 6 are arranged on the respective shaped surfaces 20 of a zigzag corrugation between two adjacent connection sleeves 4 of the same row in such a manner that bulges 6 are disposed, on the one hand, symmetrically between the two adjacent connecting sleeves 4 of one row and, on the other hand, approximately in the center between wave crest 5 and wave trough 11.

In general, the following applies:

Instead of wave crest 5 and wave trough 11, one can, more generally, also speak of corrugation crest and corrugation trough. Between each wave crest 5 and wave trough 11 there lies a slope 20 of the corrugation. The shape of bulges 6 may also be called knubs which, depending on their deformability and the tool employed, can be selected freely within certain limits. For example, in addition to the illustrated conical bulges 6, prismatic, cylindrical, sphere section shaped bulges 6 or those in the form of a parabola of revolution or of a frustopyramid or cone frustum or other raised shapes may also be employed. All bulges 6 are pressed out of the plane of rib 1 in the same direction. In addition to the zigzag shaped basic corrugation, an edge corrugation 12 may also be impressed at the entrance and exit edges of the first gaseous fluid when the heat exchanger ribs are separated to produce additional stiffening of the rib edge and reduce the escape of water from rib 1 when the temperature falls below the dew point.

All bulges 6 are closed and each has a lower height than the spacing b between ribs 1 (see FIG. 5) in the ribbed-tube heat exchanger 22 (see FIGS. 8, 9). Bulges 6 are spaced from both ends of the same slope 20 of the corrugation so that a raised portion or bulge 6 is formed only on a single slope 20 of the corrugation. In the embodiments of FIGS. 1 to 4, each slope 20 of the corrugation is covered with bulges 6 which take up between 50% and 80% of the slope length measured in the flow direction 2.

Figure 1:
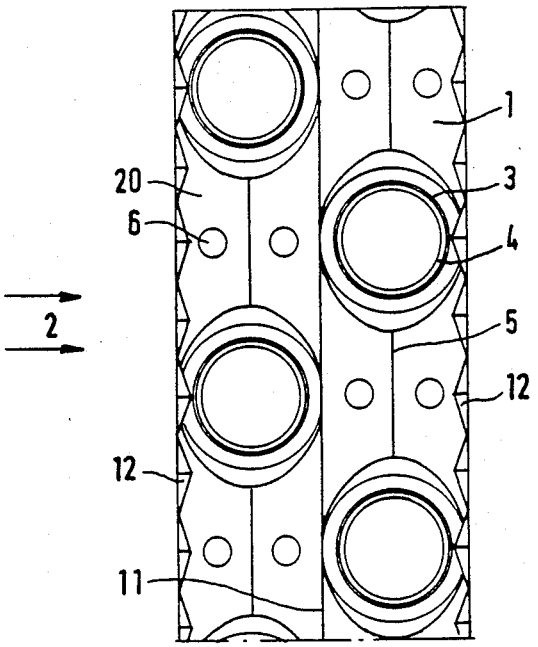
FIG. 1 is a top view of a section of a first embodiment of a rib or fin according to the invention.
Figure 2:
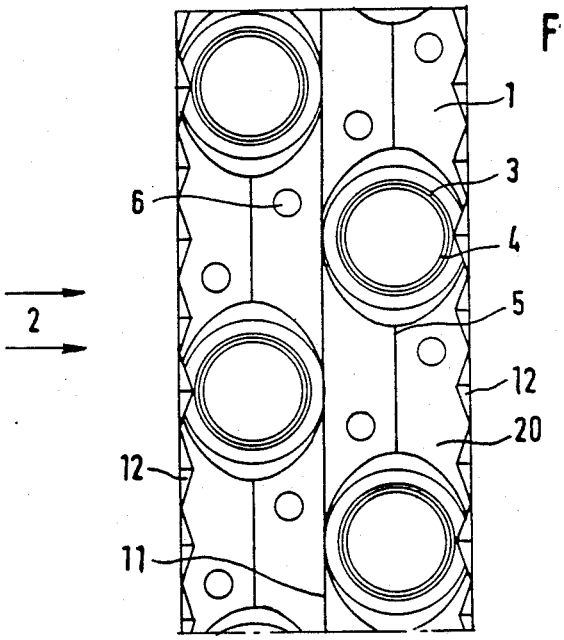
FIG. 2 is a top view of a second embodiment of a rib or fin according to the invention which is varied with respect to the arrangement of the bulges.

In the embodiment of FIG. 1, the bulges 6 of a corrugation length are flush or aligned behind each other in the flow direction 2. FIG. 2 shows an advantageous modification of the flush arrangement of the bulges 6 according to FIG. 1 in which the bulges 6 of FIG. 1 are arranged offset behind one another with respect to flow direction 2 of the first fluid. Although the offset arrangement of bulges 6 results in greater pressure losses, it does permit the realization, in parallel thereto, of a further increase in the heat transfer coefficient.

In the ribs or fins according to FIGS. 1 and 2, only one bulge 6 is provided per slope 20 between adjacent connecting sleeves 4. In FIG. 1, the bulges 6 lie in the center of slopes 20, while in FIG. 2 the bulges 6 on successive slopes 20, when seen in flow direction 2, lie symmetrically to the center of the respective slope 20 and laterally offset in mirror symmetry with respect to an imaginary center point of the adjacent connecting sleeves in the respective row.

Figure 3:
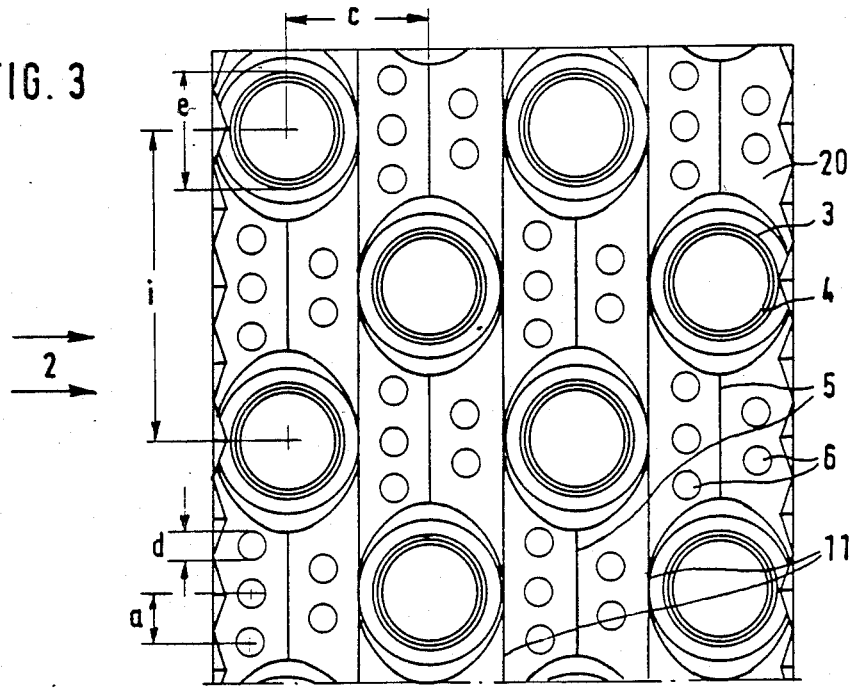
FIGS. 3 and 4 are top views of third and fourth embodiment, respectively, of a rib or fin according to the invention showing still further arrangements of the bulges.

A further optimization of the basic idea of FIG. 2 is shown in FIG. 3 in which a plurality of bulges 6, five in the special case of FIG. 3, are arranged offset with respect to flow direction 2 between two connecting sleeves 4 of the same row of tubes. On the planar rib surface between wave crest 5 and wave trough 11 between two adjacent connecting sleeves 4 of one row of heat exchanger tubes 14 or connecting sleeves 4, alternatingly three and two bulges 6 are arranged in flow direction 2 of the first fluid. The distribution of bulges 6 is here—as in the case of FIG. 4 to be discussed below—symmetrical with respect to an imaginary center line between adjacent connecting sleeves 4 and with equidistant distribution of the bulges 6 of a group of bulges 6 lying between two adjacent connecting sleeves 4.

Due to the more uniform distribution of bulges 6, which additionally are arranged more closely together in the region of the slower flow velocities between adjacent connecting sleeves 4 of a row of tubes, the heat current density is uniform on concentric circles around connecting sleeves 4.

With greater distances between connecting sleeves 4, a further increased number of bulges 6 with the same maximum bulge diameter d may be of advantage, while with very small spaces between ribs 1, it is recommended to increase the number of bulges 6 and simultaneously reduce the maximum diameter d of bulges 6.

Figure 4:
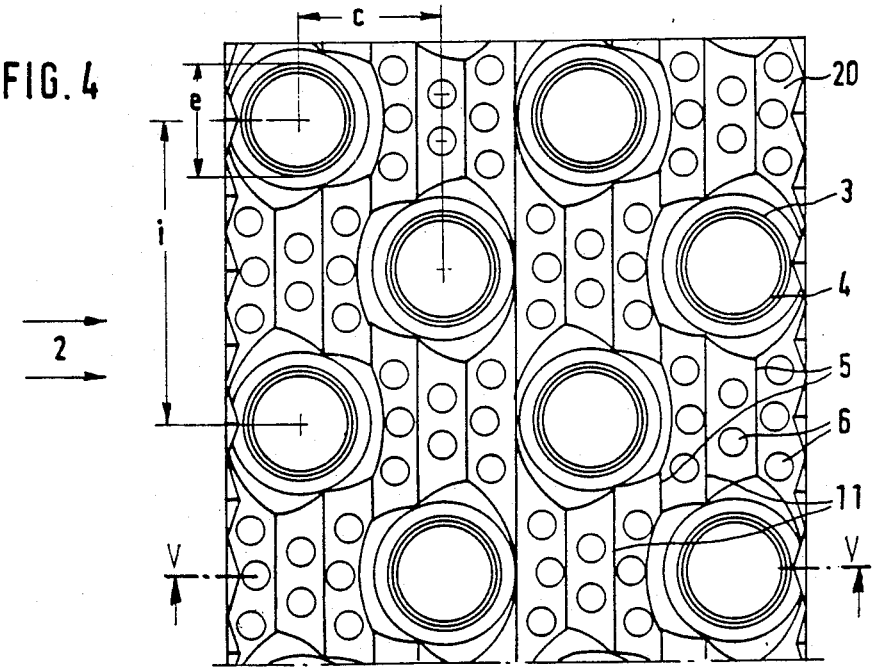

The height f (See FIG. 5) of bulges 6 in all embodiments of FIGS. 1 to 4 should be such that each bulge has a height, depending on the permissible pressure losses, which is preferably 30% to 50% of the existing rub spacing b within a heat exchanger. The distance a between the centers of adjacent bulges 6 is advisably 1 to 3 times, preferably 1.3 to 2 times, the diameter of the base surface of each individual bulge 6. A further step in the direction toward a uniform heat current density on concentric circles around connecting sleeve 4 and an external heat transfer coefficient which is homogeneously distributed over the entire surface area of the fin is shown in FIG. 4 wherein, compared to FIG. 3, the number of slopes 20 between two adjacent connecting sleeves 4 of a row of tubes has been increased from two to three. Thus, eight bulges 6 can be positioned in an offset arrangement with respect to the direction 2 of the air between two adjacent connecting sleeves 4 of a row of heat exchanger tubes 14 or connecting sleeves 4, respectively, namely in the sequence three-two-three when seen in flow direction 2. A further increase in the number of wave crests 5 is conceivable for smaller rib spacings b. The limit in the increase of the number of corrugations and bulges is set by the stream of the air which reacts to the case where the corrugation is too fine, and thus the number of bulges is extremely high, with the formation of a thicker boundary layer 9 (see FIG. 6) since the flow of the gaseous first fluid is no longer able to follow a very fine corrugation or bulge, respectively. Also, with increasing numbers of bulges, tool costs increase since, due to the required exchangeability of the tool profiles when worn, bulges 6 are punched with dies inserted into a corrugated base plate so that tool costs increase with increasing number of dies.

Advisably, the length of the individual slopes 20 of the corrugation is at least two and at most five times the distance b between ribs or fins in the ribbed-tube heat exchanger.

Figure 5:
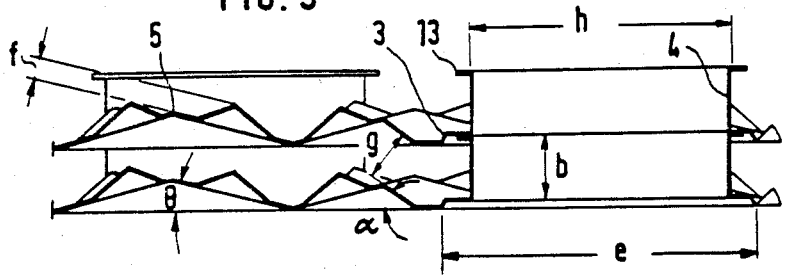
FIG. 5 is a sectional view along line V—V of FIG. 4 showing two adjacent ribs according to the invention in a ribbed-tube heat exchanger.

FIG. 5 is a sectional view of the rib 1 of FIG. 4 along line V—V of that figure, and shows the projection of all bulges 6 in one direction and the preferred relationship between the heights f of bulges 6 and the distance b between adjacent ribs 1 of a heat exchanger. Also evident is the effect of locally very large corrugation angles $\alpha$ which result in a local reduction of the distance between ribs from dimension b to dimension g and thus in increased adhesion forces between rib 1 and drops of condensation water. According to the present invention the rise angle from the edge of the receiving trough 3 to the wave crest 5 is not more than 20° steeper than the pitch angle $\theta$ of the corrugations. Moreover, the width of the annular receiving trough 3, i.e., $$\frac{e-h}{2}.$$

is less than one half of the slope length, wherein, as shown in FIG. 5, e and h are the outer and inner diameters respectively of the annular trough 3.

Figure 6:
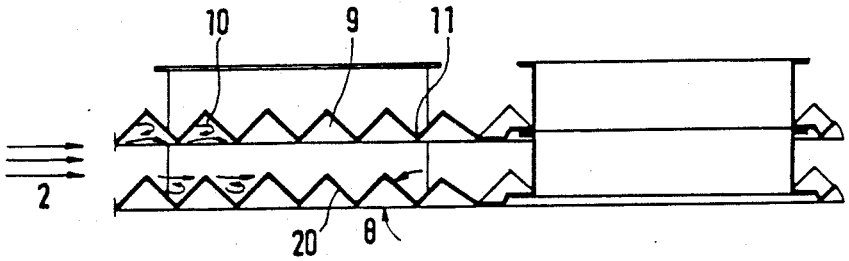
FIG. 6 PRIOR ART
FIG. 6 is a cross-sectional view corresponding to that of FIG. 5 of the prior art heat exchanger rib according to DE-OS No. 2,530,064, for comparison.

In FIG. 6, flow lines show, for a prior art rib 1 according to DE-OS No. 2,530,064 (without raised portions or bulges 6) and exclusively corrugations, the increase in boundary layer 9 which results at too large a corrugation angle $\theta$. Since the air is unable to even approximately follow rib 1, low intensity stationary turbulences 10 develop in wave troughs 11. Such turbulences have only a low boundary layer reducing effect and adapt themselves in temperature to rib or fin 1 since they are essentially stationary and are not carried along in primary flow direction 2 as are the major turbulences.

Figure 7:
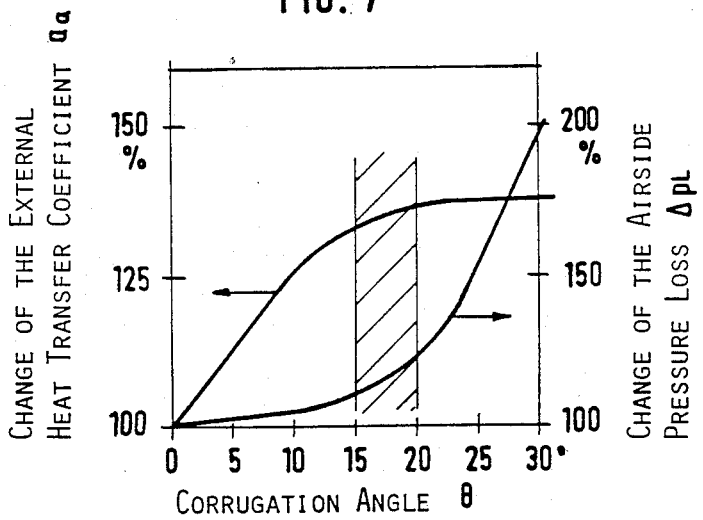
FIG. 7 is a diagram explaining the influence of the corrugation angle $\theta$ on the heat transfer coefficient and the pressure loss in exclusively zigzag corrugated ribs of the prior art.

FIG. 7 shows the resulting changes in performance and pressure losses plotted over corrugation angle $\theta$ for the device of FIG. 6. It can be seen that, beginning with corrugation angles $\theta$ of 20°, no further significant increase in performance occurs and that, at corrugation angles $\theta$ of more than 20°, there is only a steep increase in pressure losses on the air side since, moreover, with a greater corrugation angle $\theta$ and consequently increasing coefficient of resistance, the deflection also lengthens the flow path and increases flow velocity.

FIG. 8 shows how in a rib or fin tube heat exchanger 22 (see FIG. 9) mutually offset heat exchanger tubes 14 are firmly connected to connecting sleeves 4 of the individual ribs 1 in a heat conducting manner. The fastening is effected by means of methods customary in the production of rib-tube heat exchangers, for example by widening heat exchanger tubes 14 and/or hard soldering. In the packet of ribs 1, connecting sleeves 4 act as spacers between adjacent ribs 1, in that the collar 13 at the free end of each respective connecting sleeve 4 engages in the annular trough 3 at the rear of the base zone of the next following rib 1. Thus it is possible that no additional bulges in the rib need take over spacer functions.

Figure 9B:
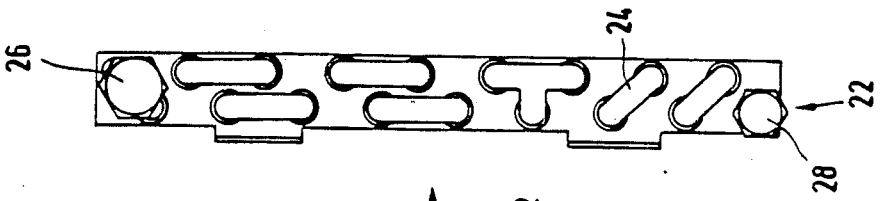
FIGS. 9*a* and 9*b* are schematic front and side views respectively of such a ribbed-tube heat exchanger.
Figure 9A:
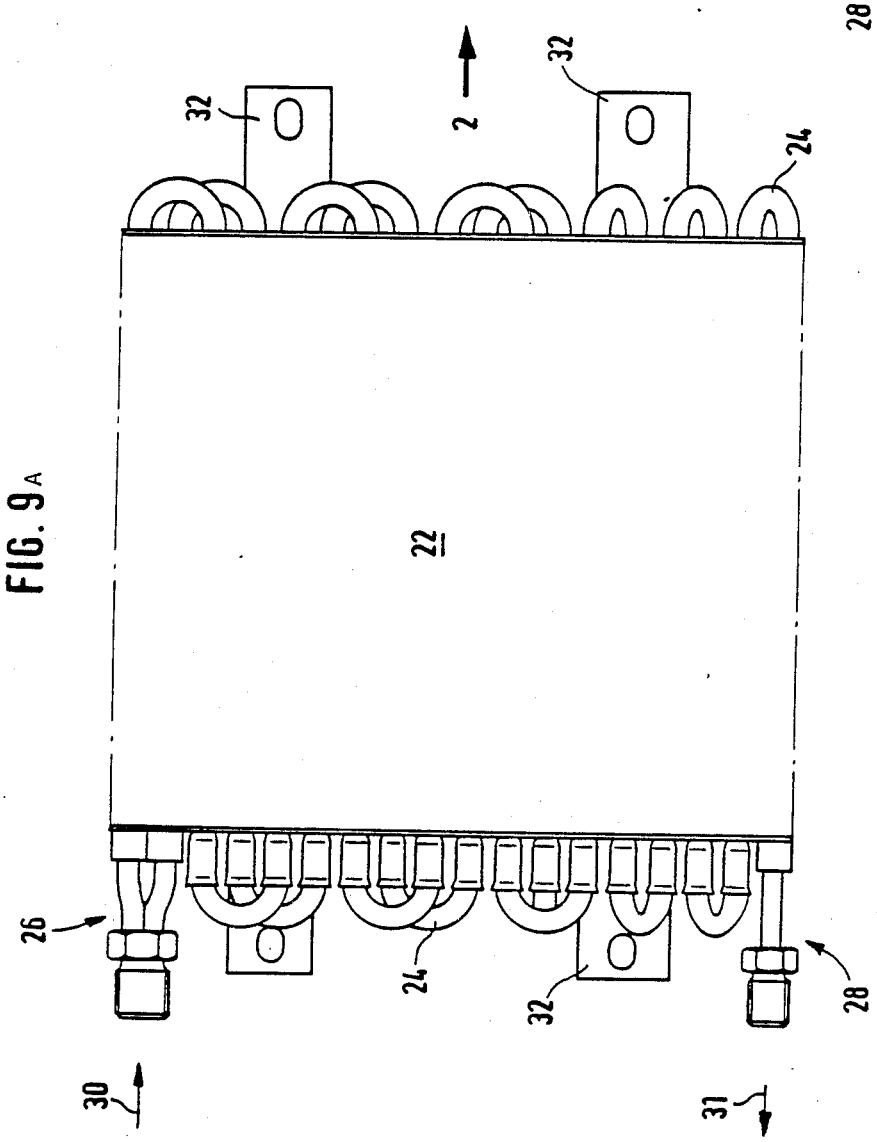

FIGS. 9*a* and 9*b* are schematic representations of an entire ribbed-tube heat exchanger 22 whose ribs are configured according to FIGS. 1, 2, 3 or 4 and are combined, according to FIG. 8, into a packet of ribs carried by heat exchanger tubes 14. The individual heat exchanger tubes 14 are here combined, with respect to flow, by means of reversal arcs 24, possibly with the use of collection boxes (not shown) or collection tubes as indicated in FIG. 9, so that the second fluid flows through them, partially in a crossed countercurrent and partially in a crossed current in the same direction as the first fluid, from a common inlet 26 to a common outlet 28 for the second fluid. The direction of flow of the second fluid is here indicated by an arrow 30 at inlet 26 and an arrow 31 at outlet 28. Moreover, FIG. 9*b* indicates the flow direction 2 of the first fluid, e.g., air. The heat exchanger 22 can be installed in an automobile by means of fastening plates 32.

The described features and characteristics of the novel rib 1 simultaneously also characterize the significant features, characteristics and, in particular, quality features of a ribbed-tube heat exchanger 22 equipped in the described manner with a packet of such ribs.

The present disclosure relates to the subject matter disclosed in German P No. 36 35 940.8 of October 22nd, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; and, on a respective said rib, each said bulge is disposed on a slope of the corrugation and is spaced from both ends of the slope in the direction of air flow, and the maximum cross-sectional dimension of each said bulge is between 50% and 80% of the length of the slope in the direction of air flow.

2. A heat exchanger as defined in claims 1, wherein said corrugation has a periodic linear zigzag course whose pitch angle ($\theta$) lies in a range from 10° to 30°.

3. A heat exchanger as defined in claim 2, wherein all of said bulges and all of said connecting sleeves project from the same surface side of each said rib.

4. A heat exchanger as defined in claim 3, wherein each slope of a respective said rib is provided with at least one of said bulges.

5. A heat exchanger as defined in claim 2, wherein, on a respective said rib, said bulges are disposed on the respective said slopes forming said at least one wave crest between two of said connecting sleeves which are adjacent one another transversely to the flow direction of the first fluid, and said bulges are aligned with one another in the flow direction of the first fluid.

6. A heat exchanger as defined in claim 2, wherein, on a respective said rib, said bulges are disposed on the respective said slopes forming said at least one wave crest between two of said connecting sleeves which are adjacent one another transversely to the flow direction of the first fluid, and said bulges are offset and not aligned with respect to one another in the flow direction of the first fluid.

7. A heat exchanger as defined in claim 1, wherein said bulges have a conical shape.

8. A heat exchanger as defined in claim 1, wherein said bulges have a peaked-roof shape.

9. A heat exchanger as defined in claims 1, wherein said bulges have the shape of a pyramid, a prism or a cylinder.

10. A heat exchanger as defined in claim 1, wherein said height (f) of said bulges is between 30% to 50% of said spacing (b) between adjacent ribs in the ribbed-tube heat exchanger.

11. A heat exchanger as defined in claims 1, further comprising a superposed edge corrugation provided on a respective said rib in the region of its edges extending transversely to the flow direction of the first fluid.

12. A heat exchanger as defined in claim 1 wherein said bulges have a closed configuration.

13. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; and, on a respective said rib, each said bulge is disposed on a slope of the corrugation and is spaced from both ends of the slope in the direction of air flow, said corrugation has a periodic linear zigzag course whose pitch angle ($\theta$) lies in a range from 10° to 30°, and a group of at least two of said bulges is arranged on the same slope and transversely to the direction of flow of the first fluid between a pair of said connecting sleeves which are adjacent one another transversely to the flow direction of the first fluid.

14. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; and, on a respective said rib, said corrugation has a periodic linear zigzag course whose pitch angle ($\theta$) lies in a range from 10° to 30°, each said bulge is disposed on a slope of the corrugation and is spaced from both ends of the slope in the direction of air flow, and a greater number of said bulges are provided in regions having broad flow cross sections for the first fluid between adjacent said connecting sleeves, and fewer or no bulges are provided in regions having a smaller flow cross section for the first fluid between adjacent said connecting sleeves.

15. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said rib being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed conically shaped bulges, each of a height of at least 15% and at most 80% of the spacing between adjacent said ribs in the ribbed-tube heat exchanger; and, on a respective said rib, each said bulge is disposed on a slope of the corrugation and is spaced from both ends of the slope in the direction of air flow, and the distance (a) between the centers of adjacent said bulges in the same one of said corrugation slopes between two adjacent said connecting sleeves and in a direction transverse to the flow direction is 1 to 3 times, preferably 1.3 to 2 times, the diameter of the base surface of the individual said bulges.

16. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; and, on a respective said rib, each said bulge is disposed on a slope of the corrugation and is spaced from both ends of the slope in the direction of air flow, and the length of the individual said slopes of said corrugation in the flow direction of the first-fluid is at least two and at most five times the spacing (b) between adjacent said ribs in the ribbed-tube heat exchanger.

17. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; and, on a respective said rib, each said bulge is disposed on a slope of the corrugation and is spaced from both ends of the slope in the direction of air flow, and three of said slopes of the corrugation are provided for each row of said connecting sleeves arranged next to one another transversely to the flow direction of the first fluid.

18. In a ribbed-tube heat exchanger for a motor vehicle having a plurality of spaced ribs for joint ribbing of a plurality of heat exchanger tubes wherein ambient air, as a first heat exchange fluid, flows in a given direction along a surface of the ribs and a second heat exchange fluid is conducted in the heat exchanger tubes, with said ribs being made of aluminum or an aluminum alloy and being corrugated in the direction of flow of the first fluid, whereby wave crests and wave troughs of the corrugations extend transverse to the direction of flow of the first fluid, and further including connecting sleeves, connecting a respective said rib to the heat exchanger tubes, fastened and shaped to the respective said rib and disposed such that at least one wave crest of the corrugations extends between two of said connecting sleeves which are disposed adjacent one another transversely to the flow direction of the first fluid, and local air guidance profiles shaped in the corrugated surface of the respective said rib in the spaces between said connecting sleeves; the improvement wherein: said air guidance profiles are constituted of at least predominantly closed bulges, each of a height of at least 15% and at most 80% of the spacing between adjacent said ribs in the ribbed-tube heat exchanger; on a respective said rib, each said bulge is disposed on a slope of the corrugation and is spaced from both ends of the slope in the direction of air flow; the respective free ends of said connecting sleeves are provided with respective collars; the side surface of a respective said rib facing away from said collars of said connecting sleeves is provided with complementary annular receiving troughs for the collars of an adjacent rib; and the width of said troughs is less than one-half of the corrugation slope length.

19. A heat exchanger as defined in claim 18, wherein the rise from each said receiving trough to the adjacent said wave crest is not more than 20° steeper than the pitch angle ($\theta$) of the corrugation.

* * * * *

UNITED STATES PATENT AND TRADEMARK OFFICE

CERTIFICATE OF CORRECTION

PATENT NO. : 4,923,002

DATED : May 8th, 1990

INVENTOR(S) : Roland Haussmann

It is certified that error appears in the above-identified patent and that said Letters Patent is hereby corrected as shown below:

On the title page of the patent under [30] please insert:
Foreign Application Priority Data
--Oct. 22, 1986 [DE] Fed. Rep. of Germany .....3635940.8--

Signed and Sealed this

Third Day of March, 1992

*Attest:*

HARRY F. MANBECK, JR.

*Attesting Officer*

*Commissioner of Patents and Trademarks*